US011699381B2

(12) United States Patent
Zhan

(10) Patent No.: US 11,699,381 B2
(45) Date of Patent: Jul. 11, 2023

(54) DISPLAY DEVICE, DRIVING METHOD THEREOF, AND ELECTRONIC DEVICE

(71) Applicant: Wuhan China Star Optoelectronics Semiconductor Display Technology Co., Ltd., Hubei (CN)

(72) Inventor: Huilan Zhan, Hubei (CN)

(73) Assignee: Wuhan China Star Optoelectronics Semiconductor Display Technology Co., Ltd., Wuhan (CN)

( * ) Notice: Subject to any disclaimer, the term of this patent is extended or adjusted under 35 U.S.C. 154(b) by 104 days.

(21) Appl. No.: 17/419,859

(22) PCT Filed: Apr. 30, 2021

(86) PCT No.: PCT/CN2021/091353
§ 371 (c)(1),
(2) Date: Jun. 30, 2021

(87) PCT Pub. No.: WO2022/222176
PCT Pub. Date: Oct. 27, 2022

(65) Prior Publication Data

US 2022/0343827 A1 Oct. 27, 2022

(51) Int. Cl.
*G09G 3/20* (2006.01)

(52) U.S. Cl.
CPC ... *G09G 3/2074* (2013.01); *G09G 2300/0842* (2013.01); *G09G 2320/0233* (2013.01); *G09G 2320/0276* (2013.01)

(58) Field of Classification Search
CPC ..... G09G 3/2074; G09G 3/3208; G09G 2300/0842; G09G 2320/0233; G09G 2320/0295; G09G 2320/0626; G09G 2320/0673; G09G 2320/0276
USPC ..... 345/55
See application file for complete search history.

(56) References Cited

U.S. PATENT DOCUMENTS

| | | | | |
|---|---|---|---|---|
| 2018/0082627 | A1* | 3/2018 | Deng | G09G 3/3275 |
| 2019/0189038 | A1 | 6/2019 | Park | |
| 2019/0206326 | A1* | 7/2019 | Wang | G09G 3/3233 |
| 2020/0090565 | A1 | 3/2020 | Sawahata | |
| 2021/0407371 | A1* | 12/2021 | Huang | G09G 3/2074 |

FOREIGN PATENT DOCUMENTS

| | | | | |
|---|---|---|---|---|
| CN | 101114441 | | 1/2008 | |
| CN | 105741763 | | 7/2016 | |
| CN | 106910483 | | 6/2017 | |
| CN | 109036265 | | 12/2018 | |
| CN | 109448638 | * | 3/2019 | G09G 3/3208 |
| CN | 110246449 | | 9/2019 | |
| CN | 110880295 | | 3/2020 | |

(Continued)

*Primary Examiner* — Jennifer T Nguyen

(57) ABSTRACT

The application provides a display device and a driving method thereof, and an electronic device. The display device driving method obtains a first driving parameter and a first compensation value of the display device, determines an abnormal driving parameter of the display device based on the first driving parameter and the first compensation value of the display device, then determines a second compensation value of the display device based on the abnormal driving parameter of the display device, and drives the display device using the second compensation value and the first driving parameter.

18 Claims, 5 Drawing Sheets

(56) References Cited

FOREIGN PATENT DOCUMENTS

| | | |
|---|---|---|
| CN | 111009207 | 4/2020 |
| CN | 111161677 | 5/2020 |
| CN | 111816121 | 10/2020 |
| WO | WO 2012/157093 | 11/2012 |
| WO | WO 2018/078813 | 5/2018 |

* cited by examiner

DISPLAY DEVICE, DRIVING METHOD THEREOF, AND ELECTRONIC DEVICE

RELATED APPLICATIONS

This application is a National Phase of PCT Patent Application No. PCT/CN2021/091353 having International filing date of Apr. 30, 2021, which claims the benefit of priority of Chinese Patent Application No. 202110439492.4 filed on Apr. 23, 2021. The contents of the above applications are all incorporated by reference as if fully set forth herein in their entirety.

BACKGROUND OF INVENTION

Field and Background of the Invention

The present invention relates to a technical field of display technologies, and more particularly, to a display device, a driving method thereof, and an electronic device.

A display panel achieves different levels of display luminance through display panel dimming control. Current display panel dimming includes a pulse width modulation (PWM) mode and a direct current (DC) dimming mode. The DC dimming mode known as being free from screen flicker is widely used.

A current display panel, due to the difference of manufacturing process stability, may have some display areas in the display panel the luminance of which cannot be obtained ideally, resulting in uneven luminance, known as mura, during displaying. Hence, it is necessary to compensate the luminance of the display panel, that is, to reduce the luminance of the display panel at a higher luminance position, and to increase luminance of the display panel at a lower luminance position, to achieve luminance uniformity of the display panel. However, in the process of luminance compensation for the display panel, when compensating a higher luminance position of the display panel, luminance of a green subpixel accounts for a higher percentage, so a luminance value of the green subpixel when compensated will first drop to zero while a luminance value of a blue subpixel and a luminance value of a red subpixel is still non-zero, which will result in a purple dot during displaying and cause poor display performance of the display panel.

Therefore, a current display panel has a driving process resulting in problems of poor compensation effects and poor display performance of the panel display.

SUMMARY OF THE INVENTION

Technical Problems

An embodiment of the application provides a display device, a driving method thereof, and an electronic device to alleviate the technical problem of poor compensation effects in the driving process of current display panels.

Technical Solutions

Embodiments of the present application provide a display device driving method comprising:

obtaining a first driving parameter and a first compensation value of the display device;

determining an abnormal driving parameter of the display device according to the first driving parameters and the first compensation values of the display device;

determining a second compensation value for the display device based on the abnormal driving parameter of the display device, wherein an absolute value of the first compensation value is greater than an absolute value of the second compensation value; and driving the display device using the second compensation value and the first driving parameter.

In some embodiments, the step of obtaining the first driving parameter and the first compensation value of the display device comprises:

obtaining a correspondence between a first display mode and a second display mode of the display device;

obtaining a to-be-displayed gray scale and a to-be-displayed luminance of the display device in the first display mode; and determining the first driving parameter and the first compensation value of the display device according to the to-be-displayed gray scale and the to-be-displayed luminance of the first display mode, and the correspondence.

In some embodiments, the step of determining the abnormal driving parameter of the display device based on the first driving parameter and the first compensation value of the display device comprises:

determining a second driving parameter and a minimum compensation value for each pixel according to the first driving parameter and the first compensation value of the display device;

and determining the abnormal driving parameter of the display device based on the second driving parameter and the minimum compensation value for each pixel.

In some embodiments, the step of determining the abnormal driving parameter of the display device based on the second driving parameters and the minimum compensation value for each pixel comprises:

determining the sub-compensation value of the subpixels in each pixel based on the second driving parameter of each pixel.

determining whether a sub-compensation value of one subpixel of the subpixels is less than the minimum compensation value based on the sub-compensation values of the subpixels and the minimum compensation value; and determining the abnormal driving parameter corresponding to the subpixels when the sub-compensation value of the subpixel is less than the minimum compensation value.

In some embodiments, the step of determining the abnormal driving parameter of the display device based on the first driving parameter and the first compensation value of the display device comprises:

driving the display device according to the first driving parameter and the first compensation value of the display device to obtain a display screen of the display device;

determining an abnormal display area of the display device based on the display screen of the display device and a standard display screen; and obtaining the first driving parameter and the first compensation value of the abnormal display area of the display device according to the abnormal display area of the display device, to obtain the abnormal driving parameter.

In some embodiments, the step of determining the second compensation value for the display device based on the abnormal driving parameter of the display device comprises:

obtaining compensation accuracy of the display device; and determining the second compensation value of the display device based on the abnormal driving parameter and the compensation accuracy of the display device.

In some embodiments, the step of determining the second compensation value for the display device based on the abnormal driving parameter and the compensation accuracy of the display device comprises:

determining a first baseline compensation coefficient and a first baseline compensation value for the display device based on the abnormal driving parameter of the display device;

determining a second baseline compensation coefficient for the display device based on the first baseline compensation coefficient and the coefficient compensation accuracy, where the compensation accuracy comprises the coefficient compensation accuracy;

determining the second compensation value for the display device based on the first baseline compensation value and the second baseline compensation coefficient.

In some embodiments, the step of determining the second compensation value for the display device based on the abnormal driving parameter of the display device comprises:

determining a first baseline compensation coefficient and a first baseline compensation value for the display device based on the abnormal driving parameter of the display device;

determining a second baseline compensation value for the display device based on the first baseline compensation value and the voltage compensation accuracy, where the compensation accuracy comprises the voltage compensation accuracy; and determining the second compensation value for the display device based on the second baseline compensation value and the first baseline compensation coefficient.

In some embodiments, the step of determining the second compensation value for the display device based on the abnormal driving parameter of the display device comprises:

determining a first baseline compensation coefficient and a first baseline compensation value for the display device based on the abnormal driving parameter of the display device;

determining a second baseline compensation coefficient and a second baseline compensation value for the display device based on the first baseline compensation coefficient, the first baseline compensation value, and the compensation accuracy; and determining the second compensation value for the display device based on the second baseline compensation coefficient and the second baseline compensation value.

In some embodiments, the step of determining the second compensation value for the display device based on the abnormal driving parameter of the display device further comprises:

storing the second compensation value.

The present application also provides a display device comprising a display device driver and a display panel. The display device driver comprises:

an acquisition module configured to obtain a first driving parameter and a first compensation value of the display device;

a first determination module configured to determine an abnormal driving parameter for the display device based on the first driving parameter and the first compensation value of the display device;

a second determination module configured to determine a second compensation value for the display device based on the abnormal driving parameter of the display device, wherein an absolute value of the first compensation value is greater than an absolute value of the second compensation value;

a storage module configured to store the second compensation value; and a driving module configured to drive the display device using the second compensation value and the first driving parameter.

In some embodiments, the display device driver is further configured to perform:

obtaining a correspondence between a first display mode and a second display mode of the display device;

obtaining a to-be-displayed gray scale and a to-be-displayed luminance of the display device in the first display mode; and determining the first driving parameter and the first compensation value of the display device according the to-be-displayed gray scale and the to-be-displayed luminance in the first display mode, and the correspondence.

In some embodiments, the display device driver is further configured to perform:

determining a second driving parameter and a minimum compensation value for each pixel according to the first driving parameter and the first compensation value of the display device; and determining the abnormal driving parameter of the display device based on the second driving parameter and the minimum compensation value for each pixel.

In some embodiments, the display device driver is further configured to perform:

determining sub-compensation values of subpixels in each pixel based on the second driving parameter for each pixel;

determining whether a sub-compensation value of one subpixel of the subpixels is less than the minimum compensation value based on the sub-compensation values of the subpixels and the minimum compensation value; and determining the abnormal driving parameter corresponding to the subpixel when the sub-compensation value of the subpixel is less than the minimum compensation value.

In some embodiments, the display device driver is further configured to perform:

driving the display device according to the first driving parameter and the first compensation value of the display device to obtain a display screen of the display device;

determining an abnormal display area of the display device based on the display screen of the display device and a standard display screen; and obtaining the first driving parameter and the first compensation value of the abnormal display area of the display device according to the abnormal display area of the display device, to obtain the abnormal driving parameter.

In some embodiments, the display device driver is further configured to perform:

obtaining compensation accuracy of the display device; and determining the second compensation value of the display device based on the abnormal driving parameter and the compensation accuracy of the display device.

In some embodiments, the display device driver is further configured to perform:

determining a first baseline compensation coefficient and a first baseline compensation value for the display device based on the abnormal driving parameter of the display device;

determining a second baseline compensation coefficient for the display device based on the first baseline compensation coefficient and the coefficient compensation accuracy; and determining the second compensation value for the display device based on the first baseline compensation value and the second baseline compensation coefficient.

In some embodiments, the display device driver is further configured to perform:

determining a first baseline compensation coefficient and a first baseline compensation value for the display device based on the abnormal driving parameter of the display device;

determining a second baseline compensation value for the display device based on the first baseline compensation value and a voltage compensation accuracy; and determining the second compensation value for the display device based on the second baseline compensation value and the first baseline compensation coefficient.

In some embodiments, the display device driver is further configured to perform:

determining a first baseline compensation coefficient and a first baseline compensation value for the display device based on the abnormal driving parameter of the display device;

determining a second baseline compensation coefficient and a second baseline compensation value for the display device based on the first baseline compensation coefficient, the first baseline compensation value, and the compensation accuracy; and determining a second compensation value for the display device based on the second baseline compensation coefficient and the second baseline compensation value.

The present application further provides an electronic device comprising a memory and a processor. The memory stores a computer program, and the processor is configured to execute the computer program in the memory to perform operations in the aforementioned driving method of the display device.

Useful Effects

The application provides a display device and a driving method thereof, and an electronic device. The display device driving method obtains a first driving parameter and a first compensation value of the display device, determines an abnormal driving parameter of the display device based on the first driving parameter and the first compensation value of the display device, then determines a second compensation value of the display device based on the abnormal driving parameter of the display device, and drives the display device using the second compensation value and the first driving parameter. By modifying compensation values for the display panel when the display panel appears to be poorly compensated, the first compensation value is modified to the second compensation value smaller than the first compensation value, and the application prevents the display panel from being overcompensated, eliminates the purple dot in the display panel, and prevents the display panel from poor displaying effects.

DESCRIPTION OF SPECIFIC EMBODIMENTS OF THE INVENTION

To make the purposes, technical solutions, and effects of the present application clearer and more explicit, the application is described in further detail hereinafter with reference to the accompanying drawings and by way of embodiments. Note that the specific embodiments described herein are intended to explain the application only and are not intended to limit the application.

A current display panel uses a set of gamma bands in a PWM mode or a DC mode, so mura of low luminance and medium gray scale in DC mode is the same as mura of high luminance and low gray scale in PWM mode. For example, the normal maximum display luminance of PWM mode is 500 nits, and the gamma curve is calculated by the formula:

$$L/L\ \max=(\text{Gray}/255)\hat{}2.2;$$

where L is a luminance value, Lmax is the maximum luminance value, Gray is a gray scale, then Gray64 with 2 nits in the DC mode is approximately equivalent to Gray5 with 500 nits in the PWM mode, that is, mura of gray scale 64 with 2 nits in the DC mode is the same as mura of gray scale 5 at 500 nits in the PWM mode.

Figure 1:
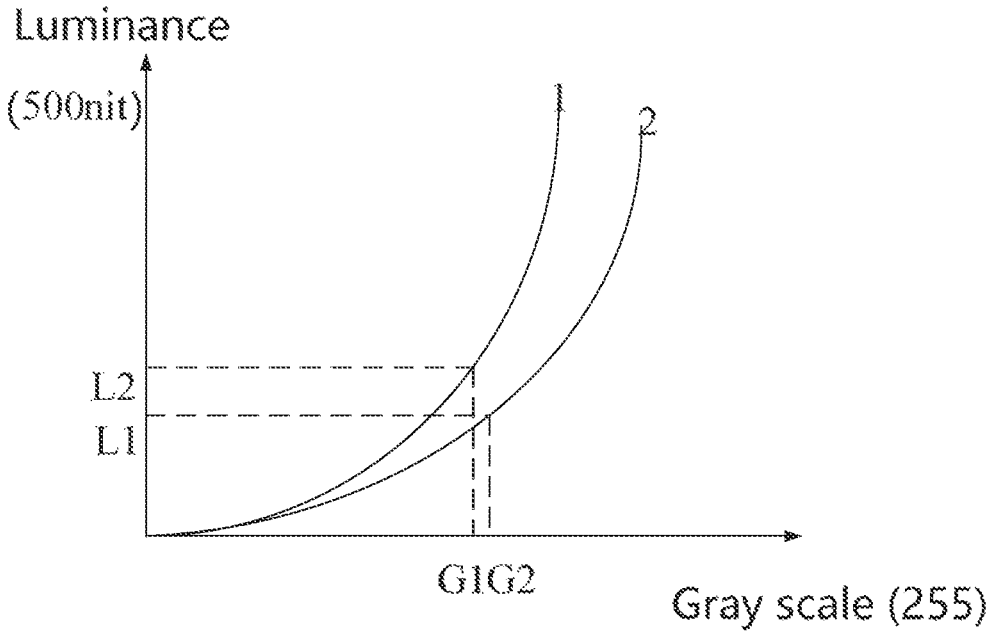
FIG. 1 is a schematic diagram showing a contrast chart between a theoretical display luminance curve and an actual display luminance curve of a current display device.

As shown in FIG. 1, a horizontal coordinate axis represents gray scales, a vertical coordinate axis represents luminance values, theoretical display luminance values of the display panel in respective gray scales are shown as a curve 1, and the actual display luminance values of the display panel in respective gray scales are shown as a curve 2. Note that the display panel needs compensation in the DC mode. Currently, compensation of the display panel is to reduce luminance at a higher luminance position and increase luminance at a lower luminance position of the display panel. In an example of a DC mode with 2 nits and Gray64, a PWM mode corresponding to the DC mode is a PWM mode with 500 nits and Gray5, that is, 5 levels of gray scale remain as an upper limit for gray scale reducing in the DC mode. When the luminance of the display panel is high, gray scales of the red, green, and blue of the display panel need to be reduced by 5 gray levels. Since the luminance of the green subpixel of the display panel counts for a larger proportion of the luminance of the display panel, the green subpixel only needs to be reduced by 3 gray levels while each of a red subpixel and a blue subpixel has two extra gray levels during display, resulting in a purple color synthesized by the red subpixel and the blue subpixel when displaying, and purple dots on the display panel.

Figure 2:
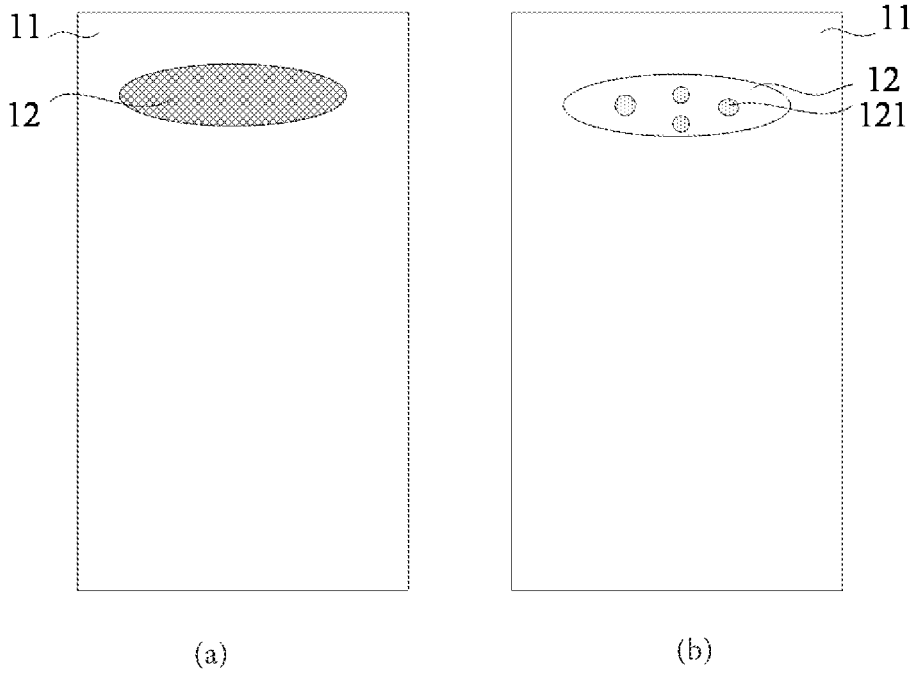
FIG. 2 is a schematic diagram showing a contrast chart of the current display device before and after compensation.

As shown in FIG. 2, the display panel includes a normal display area 11 and an over-bright display area 12. FIG. 2 (*a*) shows the display effect of the display panel before compensation, and FIG. 2 (*b*) shows the display effect of the display panel after compensation. As shown in FIG. 2 (*b*), the luminance of the over-bright display area 12 is reduced after compensation, but a purple dot 121 appears in the over-bright display area 12, resulting in poor display performance on the display panel.

In response to the above technical problems, an embodiment of the application provides a display device and a driving method thereof to alleviate the above technical problems.

Figure 3:
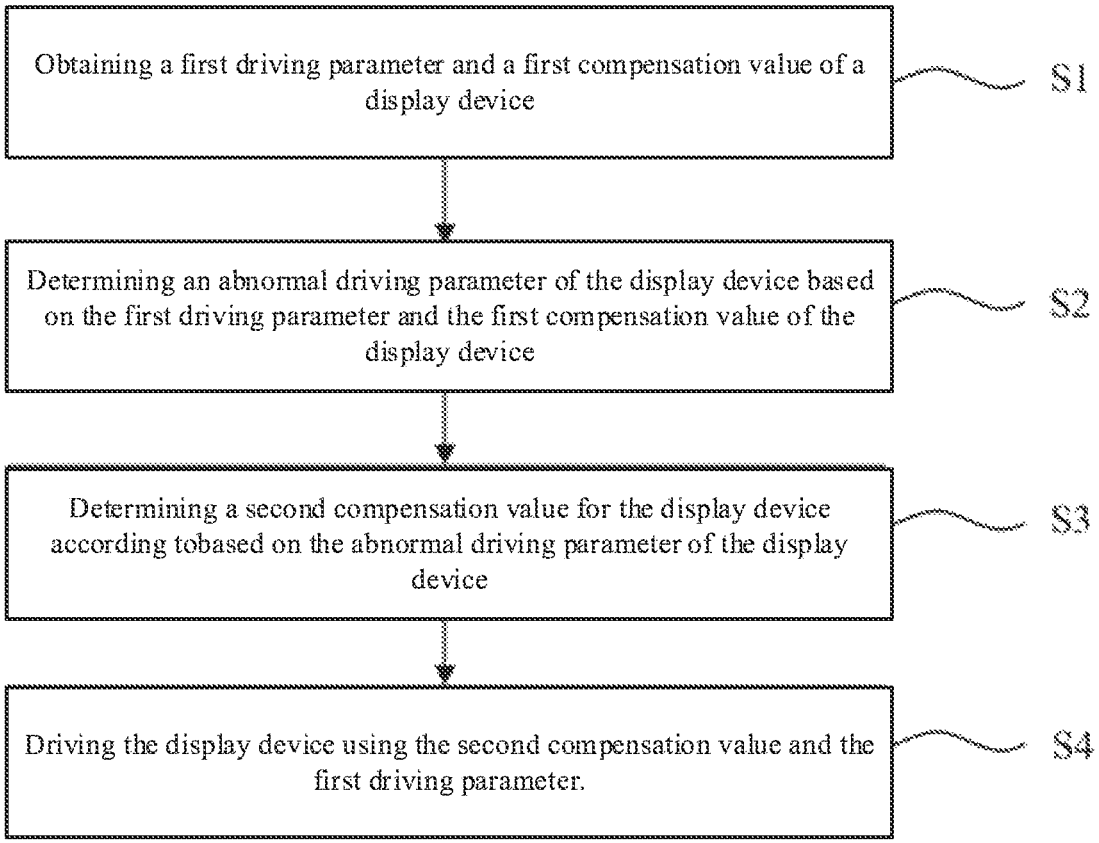
FIG. 3 is a flowchart of a driving method of a display device provided in an embodiment of the application.

As shown in FIG. 3, embodiments of the present application provide a display device driving method, the display device driving method comprising.

S1: obtaining the first driving parameter and the first compensation value of the display device;

S2: determining an abnormal driving parameter of the display device based on the first driving parameter and the first compensation value of the display device;

S3: determining a second compensation value for the display device based on the abnormal driving parameter of the display device, where an absolute value of the first compensation value is greater than an absolute value of the second compensation value; and S4: driving the display device using the second compensation value and the first driving parameter.

An embodiment of the application provides a display panel driving method that modifies the compensation value of the display panel by modifying the first compensation value to the second compensation value when the compensation effect of the display panel is not good, the second compensation value is smaller than the first compensation value to prevent the display panel from being over-compensated, eliminate the purple dot in the display panel, and avoid the bad display effects on the display panel.

Note that the first driving parameter can include a first driving voltage, the first compensation value may include a first compensation voltage and a first compensation gray scale, the abnormal driving parameter may include an abnormal driving voltage, and the second compensation value may include a second compensation voltage and a second compensation gray scale.

Note that since the display panel may have dark areas, the problem of purple dots may not be induced from compensation for dark areas. Therefore, in an embodiment of the application, the poor display effects refer to the purple-dot display problems associated with compensation for over-bright areas, and the abnormal driving parameter refers to the voltage of the display panel when purple dots appear.

Different display modes utilized in the display panel have complex problems of using different driving methods for different display modes. In one embodiment, the step of obtaining the first driving parameter and the first compensation value of the display device may include:

obtaining a correspondence between a first display mode and a second display mode of the display device;

obtaining a to-be-displayed gray scale and a to-be-displayed luminance of the display device in the first display mode; and determining the first driving parameter and the first compensation value of the display device according to the to-be-displayed gray scale and the to-be-displayed luminance of the first display mode and the correspondence between the first display mode and the second display mode. By establishing the correspondence between the first display mode and the second display mode, the first driving parameter and the first compensation value of the display panel can be determined after the to-be-displayed gray scale and the to-be-displayed luminance of the first display mode are determined, so that the display panel can perform display functions according to the display mode, and driving parameters and compensation values of the different display modes may be written into a driver chip that accordingly drives the display device to display the to-be-displayed screen.

In an embodiment of the application, the first driving parameter is an actual driving parameter of the display device, and a theoretical driving parameter of the display device can be obtained from the first driving parameter compensated by the first compensation value, so that the display panel can display normally. The problem of purple dots, however, actually can be caused by the compensation. Therefore, the first compensation value is modified to the second compensation value, so that the first driving parameter can be compensated when the display device is driven using the first driving parameter and the second compensation value, and the display device is protected from bad display performance.

In one embodiment, the first display mode may be a DC mode, and the second display mode may be a PWM mode.

To address the problem of purple dots on the display panel caused by over-compensation during the compensation process, and the problem of difficulties to accurately locating the areas of the purple dots, in one embodiment, the step of determining an abnormal driving parameter of the display device based on the first driving parameter and the first compensation value of the display device comprises:

determining a second driving parameter and a minimum compensation value for each pixel according to the first driving parameter and the first compensation value of the display device; and determining the abnormal driving parameter of the display device based on the second driving parameter and the minimum compensation value for each pixel.

In one embodiment, the second driving parameter is the driving parameter after each pixel is compensated by the first compensation value, and the minimum compensation value is the compensation value for the display panel without purple dots.

In an embodiment of the application, by determining the abnormal driving parameter of the display device after obtaining the second driving parameter and the minimum compensation value for each pixel, the areas of the purple dots in the display device can be determined, so that the areas of the purple dot can be processed to facilitate normal display performance of the display panel.

In one embodiment, the step of determining the abnormal driving parameter for the display device based on the second driving parameter and the minimum compensation value for each pixel comprises:

determining sub-compensation values of the subpixels in each pixel based on the second driving parameter for each pixel;

determining whether a sub-compensation value of one subpixel of the subpixels is less than the minimum compensation value based on the sub-compensation values of the subpixels and the minimum compensation value; and determining the abnormal driving parameter corresponding to the subpixel when the sub-compensation value of the subpixel is less than the minimum compensation value. That is, after obtaining the second driving parameter of each pixel, the sub-compensation value of each subpixel is determined. Whether an abnormal driving parameter occurs can be determined by comparing the sub-compensation value of the subpixel with the minimum compensation value. For example, if the minimum compensation value of the green subpixel is −8 gray levels, and the sub-compensation value of the green subpixel is −9 gray levels, it is determined that an abnormal driving parameter occurs, and a corresponding abnormal driving parameter associated with a subpixel can be determined based on the sub-compensation value of the subpixel, and processed accordingly.

Note that the sub-compensation value includes sub-compensation voltage and sub-compensation gray scale, and the minimum compensation value includes minimum compensation voltage and minimum compensation gray scale.

Specifically, since a compensation offset of the green subpixel drops to 0 first when the display panel has a display anomaly, the sub-compensation value of the green subpixel can be compared with the minimum compensation value to determine the abnormal driving parameter of the display panel.

Specifically, considering that the first compensation value of a pixel may exceed the minimum compensation value when the display panel has a display anomaly, the abnormal driving parameter of the display panel can be determined based on the first compensation value of the pixel and the minimum compensation value.

In one embodiment, determining of the minimum compensation value of the display panel can be made based on the sub-compensation values of subpixels. For example, at a certain luminance and a certain gray scale where the gray scale of the green subpixel of the display panel drops to 0 and causes purple dots, a compensation value corresponding to the certain luminance and the certain gray level may be used as the minimum compensation value, and the abnormal driving parameter is determined based on the first compensation value of the pixel or the sub-compensation values of the subpixels, and the minimum compensation value.

For the problem of not being able to accurately find a display anomaly when the display panel is compensated, in one embodiment, the step of determining the abnormal driving parameter of the display device based on the first driving parameter and the first compensation value of the display device comprises:

driving the display device according to the first driving parameter and the first compensation value of the display device to obtain a display screen of the display device;

determining an abnormal display area of the display device based on the display screen of the display device and a standard display screen; and obtaining the first driving parameter and the first compensation value of the abnormal display area of the display device according to the abnormal display area of the display device, to obtain the abnormal driving parameter. By driving the display device and observing display effects of the display device while the display device is displaying, the abnormal display area of the display device is thereby determined based on the display effects of the display device, and accordingly the abnormal driving parameter corresponding to the abnormal display area can be determined.

In one embodiment, when the abnormal display area of the display device is determined by the display screen of the display device and the standard display screen, a display area having a purple dot in the display screen of the display device can be determined as the abnormal display area. Alternatively, the abnormal driving parameter can be determined by comparing the display screen with the standard display screen and treating dissimilar areas of the two display screens as the abnormal display areas. In comparing the two display screens, the comparison can be performed by the image recognition device to avoid human errors in the observation.

To address the problem of poor display performance after compensation of the display panel, in one embodiment, the step of determining a second compensation value for the display device based on the abnormal driving parameter of the display device comprises:

obtaining compensation accuracy of the display device;

determining the second compensation value of the display device based on the abnormal driving parameter and the compensation accuracy of the display device. By obtaining the compensation accuracy of the display device, the compensation value of the display device may be adjusted based on the compensation accuracy and the abnormal driving parameter when the display device has a display anomaly, so that the display device does not display abnormally when being driven according to the second compensation value and the first driving parameter.

In one embodiment, the compensation accuracy of the display device is 0.5 gray scale, the accuracy of the compensation values of the display device can be determined according to the correspondence between the gray scale and the voltage. The abnormal driving parameter can be modified according to the accuracy of the compensation value of the display device to obtain the driving parameters for normal display performance.

The above embodiment is a description of modifying the abnormal driving parameter of the display device. In one embodiment, the first compensation value can also be modified to obtain the second compensation value; the first compensation value is obtained based on the abnormal driving parameter; and the second compensation value is obtained based on the first compensation value and the compensation accuracy. For example, if the compensation accuracy of voltage is 0.5 gray scale and the first compensation value is −8 gray scale, the second compensation value can be −7.5 gray scale, thus to prevent display anomaly when compensating the display device.

To address the problem of poor display performance after compensation of the display panel, in one embodiment, the step of determining a second compensation value for the display device based on the abnormal driving parameter of the display device and the compensation accuracy comprises:

determining a first baseline compensation coefficient and a first baseline compensation value for the display device based on the abnormal driving parameter of the display device;

determining a second baseline compensation coefficient for the display device based on the first baseline compensation coefficient and coefficient compensation accuracy, where the compensation accuracy comprises the coefficient compensation accuracy;

determining the second compensation value for the display device based on the first baseline compensation value and the second baseline compensation coefficient. After obtaining the abnormal driving parameter of the display device, considering that the first compensation value of the display device is determined by the first baseline compensation coefficient and the first baseline compensation value, the second baseline compensation coefficient of the display device is determined according to the first baseline compensation coefficient and the coefficient compensation accuracy of the display device when the display device has a display anomaly, so that the second compensation value of the display device is determined by the second baseline compensation coefficient and the first baseline compensation value, and an absolute value of the second compensation value of the display device is less than an absolute value of the first compensation value to prevent the display device from a display anomaly when displaying.

In an embodiment of the application, the first baseline compensation coefficient is a compensation coefficient corresponding to the first compensation value of the display device, the first baseline compensation value is a baseline compensation value corresponding to the first compensation value, and the first compensation value is determined by the first baseline compensation coefficient and the first baseline compensation value.

In an embodiment of the application, the coefficient compensation accuracy is the compensation accuracy of the first baseline compensation coefficient, which can be 0.01 or 0.1, and an embodiment of the application is not limited hereto this, and the compensation accuracy can be set according to the demand.

In an embodiment of the application, the voltage compensation accuracy is the compensation accuracy of the first baseline compensation value, which is the accuracy that has an impact on the display screen of the display device. For example, if a significant difference in the display screen of the display device is detectable when the voltage is changed by 0.1 V, the voltage compensation accuracy is set to 0.1 V. An embodiment of the application is not limited thereto, and the voltage compensation accuracy may be set according to the actual driving parameters.

The above embodiment provides a detailed description of the adjustment of the first baseline compensation coefficient of the display device to prevent the display device from display anomalies. Adjustment of the first baseline compensation coefficient may change the compensation value of all the areas. However, only the driving parameters of the areas of the display anomalies need to be modified to avoiding display anomalies in the display device. Therefore, in one embodiment, the step of determining a second compensation value of the display device based on the abnormal driving parameter of the display device comprises:

determining a first baseline compensation coefficient and a first baseline compensation value for the display device based on the abnormal driving parameter of the display device.

determining a second baseline compensation value of the display device based on a first baseline compensation value and a voltage compensation accuracy of the display device, where the compensation accuracy comprises a voltage compensation accuracy;

determining the second compensation value of the display device according to the second baseline compensation value and the first baseline compensation coefficient. By modifying the first baseline compensation value of the display device the first baseline compensation value in the area where the display anomaly occurs is modified to be the second baseline compensation value, the first compensation value can be modified to the second compensation value. Accordingly, since the absolute value of the second compensation value is smaller than the absolute value of the first compensation value, the compensation value of the green subpixel does not become 0 during the compensation, thereby preventing the display device from purple dots. The modification of the first baseline compensation value can be performed to each subpixel in accuracy of subpixel, so as to avoid side effects of the compensation of the display abnormal areas that lead to the poor display performance in other areas.

In one embodiment, the step of determining a second compensation value for the display device based on the abnormal driving parameter of the display device comprises:

determining a first baseline compensation coefficient and a first baseline compensation value for the display device based on the abnormal driving parameter of the display device;

determining a second baseline compensation coefficient and a second baseline compensation value for the display device based on the first baseline compensation coefficient and the first baseline compensation value, and the compensation accuracy;

determining a second compensation value for the display device based on the second baseline compensation coefficient and the second baseline compensation value. When the first compensation value of the display device is adjusted, and the display device is compensated by the second compensation value to display properly, the first baseline compensation coefficient and the first baseline compensation value of the display device can be modified simultaneously according to the demand so as to prevent the display device from purple dots while compensating the brighter areas of the display device.

In an embodiment of the application, the second baseline compensation coefficient is a compensation coefficient corresponding to the second compensation value of the display device, the second baseline compensation value is a baseline compensation value corresponding to the second compensation value, and the second compensation value is determined by the second baseline compensation coefficient and the second baseline compensation value.

Figure 4:
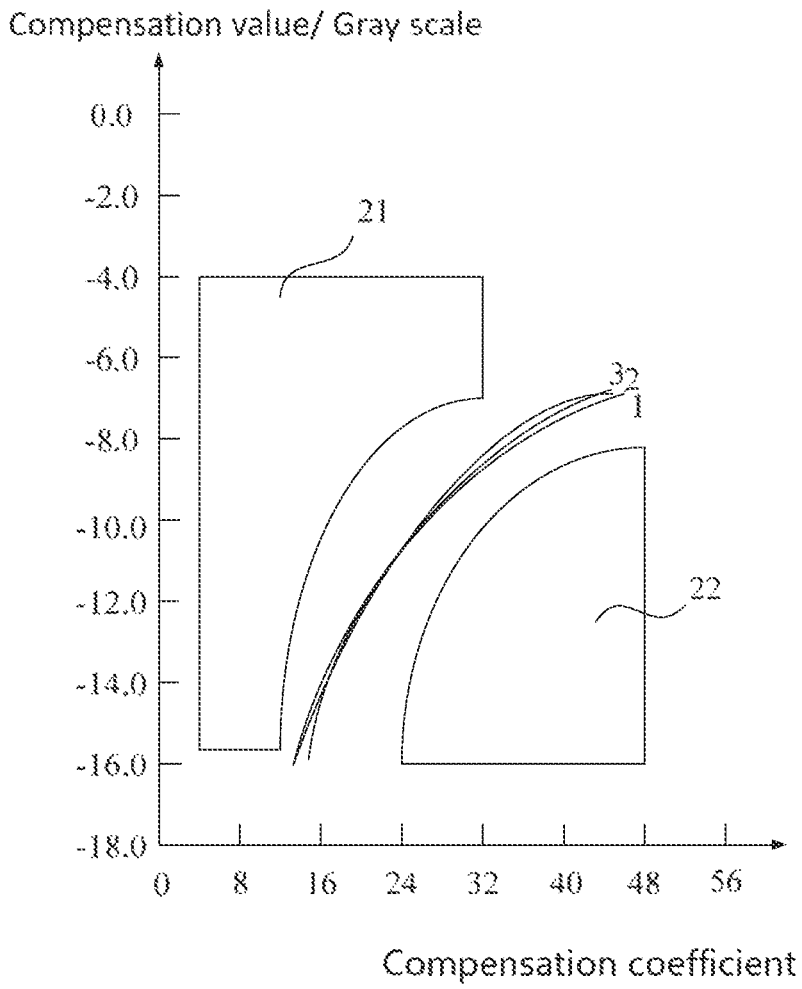
FIG. 4 is a schematic diagram showing curves of compensation values versus compensation coefficients of the display device provided in an embodiment of the application.

In one embodiment, the compensation value=a baseline compensation value*a compensation coefficient. In an example of a DC mode with 2 nits and Gray64, a corresponding PWM mode of the DC mode is 500 nits Gray5, where FIG. 4 shows a curve diagram of a normal display area and an abnormal display area of the display device, obtained according to testing of the display device. A curve 1 is a theoretical curve if the PWM mode of 500 nits and Gray5. A curve 2 is an actual curve of the PWM mode of 500 nits and Gray5. A curve 3 is an actual curve of the DC mode of 2 nits and Gray64. An area 21 is the normal display area, and an area 22 is an area where the purple dots appear. Critical values of the compensation coefficient and the compensation value when the purple dot appears are obtained. The following table shows compensation values for purple dots under different compensation coefficients:

TABLE 1

Compensation values for purple dots with different compensation coefficients

| Compensation coefficient | | PWM mode of 500 nits and Gray5 | | DC mode of 2 nits and Gray64 |
|---|---|---|---|---|
| Hexa-decimal | Deci-mal | Theoretical value | Actual value | Actual value |
| 10 | 16 | −16.5 | −16.5 | −17 |
| 11 | 17 | −15.6 | −15.5 | −16 |
| 12 | 18 | −14.7 | −15 | −15 |
| 13 | 19 | −14.0 | −14 | −14.5 |
| 14 | 20 | −13.3 | −13 | −13.5 |
| 15 | 21 | −12.7 | −12.5 | −13 |
| 16 | 22 | −12.1 | −12 | −12.5 |

TABLE 1-continued

| Compensation values for purple dots with different compensation coefficients | | | | |
|---|---|---|---|---|
| Compensation coefficient | | PWM mode of 500 nits and Gray5 | | DC mode of 2 nits and Gray64 |
| Hexa-decimal | Deci-mal | Theoretical value | Actual value | Actual value |
| 17 | 23 | −11.6 | −11.5 | −12 |
| 18 | 24 | −11.2 | −11 | −11.5 |
| 19 | 25 | −10.7 | −10.5 | −11 |
| 1A | 26 | −10.3 | −10 | −10.5 |
| 1B | 27 | −10.0 | −10 | −10 |
| 1C | 28 | −9.6 | −9.5 | −9.5 |
| 1D | 29 | −9.3 | −9 | −9.5 |
| 1E | 30 | −9.0 | −9 | −9 |
| 1F | 31 | −8.8 | −8.5 | −9 |
| 20 | 32 | −8.5 | −8.5 | −8.5 |
| 21 | 33 | −8.3 | −8 | −8.5 |
| 22 | 34 | −8.0 | −8 | −8 |
| 23 | 35 | −7.8 | −7.5 | −8 |
| 24 | 36 | −7.6 | −7.5 | −7.5 |
| 25 | 37 | −7.4 | −7 | −7.5 |
| 26 | 38 | −7.2 | −7 | −7 |
| 27 | 39 | −7.1 | −7 | −7 |
| 28 | 40 | −6.9 | −6.5 | −7 |
| 29 | 41 | −6.7 | −6.5 | −6.5 |
| 2A | 42 | −6.6 | −6.5 | −6.5 |
| 2B | 43 | −6.5 | −6 | −6.5 |
| 2C | 33 | −6.3 | −6 | −6.5 |
| 2D | 45 | −6.2 | −6 | −6 |
| 2E | 36 | −6.1 | −6 | −6 |
| 2F | 47 | −5.9 | −5.5 | −6 |
| 30 | 48 | −5.8 | −5.5 | −6 |

According to FIG. 4 and Table 1, the display device may have purple dots when the compensation value of the display device exceeds the critical value. For example, when the compensation coefficient is 34, the compensation value is −8 gray scales, purple dots appear on the display device. The compensation value of the display device can be set to −7.5 gray levels, and the second compensation value of the display device can be accordingly determined, so that the display device can not only suppress display unevenness but also purple dots on the display.

Figure 5:
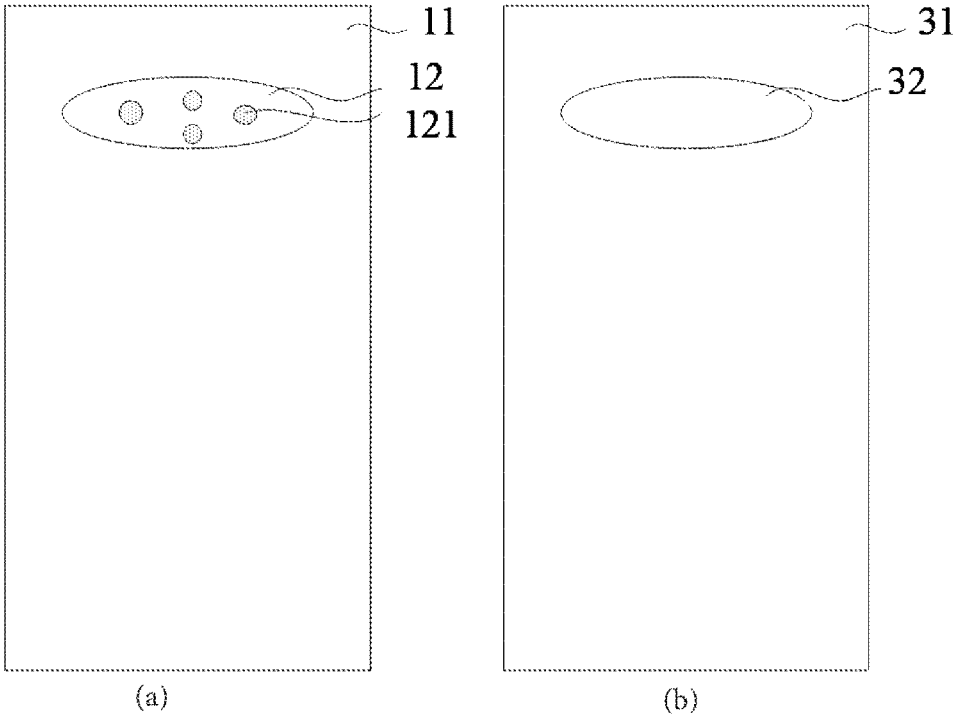
FIG. 5 is a schematic diagram showing the display device after the first compensation and the second compensation according to an embodiment of the application.

As shown in FIG. 5, FIG. 5 (*a*) shows display performance of the display device after compensation by the first compensation value, and FIG. 5 (*b*) shows display performance of the display device after compensation by the second compensation value. The display device includes a first display area 31 and a second display area 32. After being compensated, the second display area 32 does not show purple dots, and the display panel can display normally. The display panel can be displayed normally.

Figure 6:
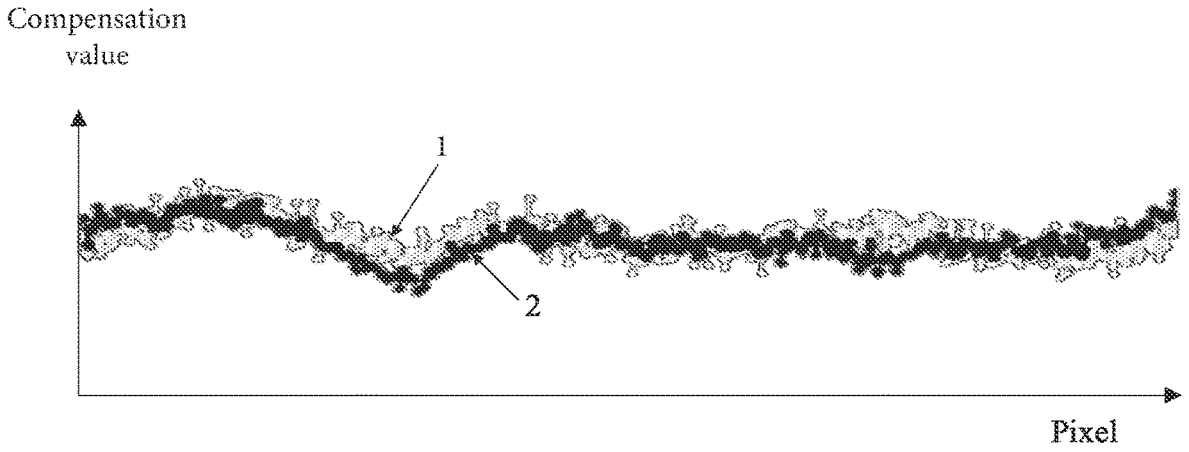
FIG. 6 is a first contrast chart showing a first compensation value and a second compensation value of the display device provided in an embodiment of the application.

As shown in FIG. 6, horizontal coordinates are pixels, vertical coordinates are compensation values, a curve 1 is a curve of the first compensation value corresponding to each pixel, and a curve 2 is a curve of the second compensation value corresponding to each pixel. As can be seen from FIG. 6, the curve 1 and the curve 2 share approximately the same overall trends, implying that the curves are not obtained using the driving method of this application.

Figure 7:
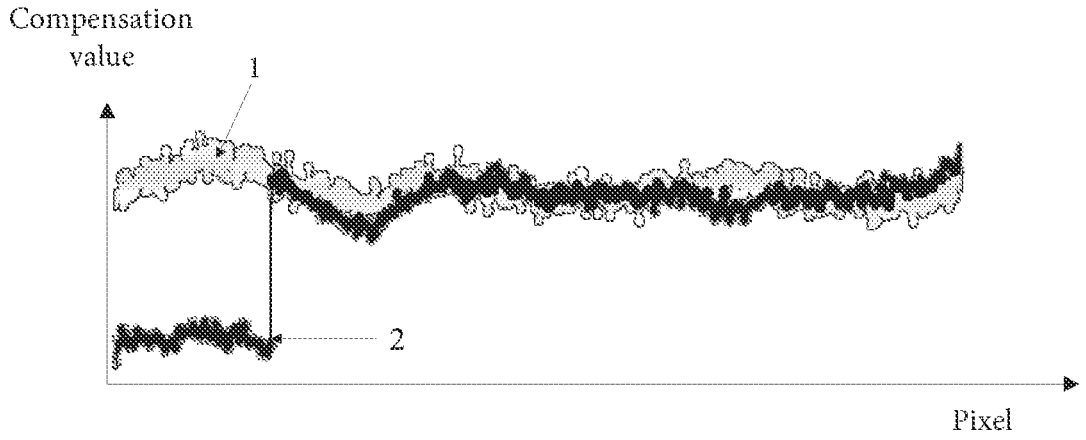
FIG. 7 is a second contrast chart showing a first compensation value and a second compensation value of the display device provided in an embodiment of the application.

As shown in FIG. 7, a horizontal coordinate represents a pixel, a vertical coordinate represents a compensation value. A curve 1 is a curve of the first compensation value corresponding to each pixel, and a curve 2 is the curve of the second compensation value corresponding to each pixel. As shown in FIG. 7, in some areas (i.e., the areas where the purple dots appear), the difference between the first compensation value and the second compensation value is greater. The display device can be compensated by the second compensation value to prevent a display panel from purple dots.

Figure 8:
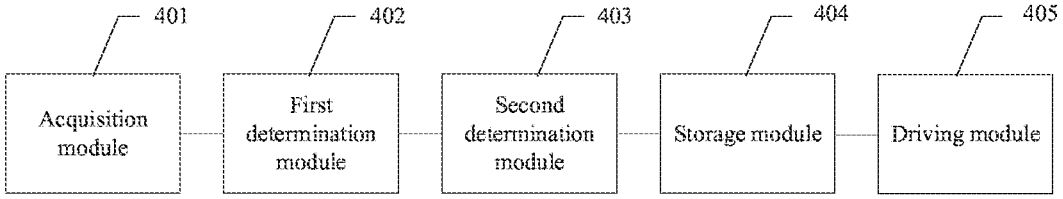
FIG. 8 is a schematic diagram showing the display device provided in an embodiment of the application.

As shown in FIG. 8, embodiments of the present application provide a display device comprising a display device driver and a display panel. The display device driver comprises:

an acquisition module 401 configured to obtain the first driving parameter and the first compensation value of the display device;

a first determination module 402 configured to determine an abnormal driving parameter for the display device based on the first driving parameter and the first compensation value of the display device;

a second determination module 403 configured to determine a second compensation value for the display device based on the abnormal driving parameter of the display device, where an absolute value of the first compensation value is greater than an absolute value of the second compensation value;

a storage module 404 configured to store the second compensation value; and a driving module 405 configured to drive the display device using the second compensation value and the first driving parameter.

In the display device of the present application, the display device driver is further configured to obtain a correspondence between the first display mode and the second display mode of the display device; to obtain the to-be-displayed gray scale and the to-be-displayed luminance of the display device in the first display mode; to determine the first driving parameter and the first compensation value of the display device based on the to-be-displayed gray scale and the to-be-displayed luminance of the first display mode and the correspondence between the first display mode and the second display mode.

In the display device of the present application, the display device driver is further configured to determine a second driving parameter and a minimum compensation value for each pixel based on the first driving parameter and the first compensation value for the display device; and to determine an abnormal driving parameter for the display device based on the second driving parameter and the minimum compensation value for each pixel.

In the display device of the present application, the display device driver is further configured to determine sub-compensation values of subpixels of each pixel based on the second driving parameter of each pixel, to determine whether the sub-compensation value of each subpixel is less than the minimum compensation value based on the sub-compensation values of the subpixels and the minimum compensation value, and to determine the abnormal driving parameter of the display device when a sub-compensation value of one of the subpixels is less than the minimum compensation value.

In the display device of the present application, the display device driver is further configured to drive the display device to obtain a display screen of the display device based on a first driving parameter and a first compensation value of the display device, to determine an abnormal display area of the display device based on the display screen of the display device and a standard display screen, to obtain the first driving parameter and first compensation value of the abnormal display area of the display device according to the abnormal display area of the display device, and to obtain the abnormal driving parameter.

In the display device of the present application, the display device driver is further configured to obtain a compensation accuracy of the display device, and to determine a second compensation value of the display device based on the abnormal driving parameter and the compensation accuracy of the display device.

In the display device of the present application, the display device driver is further configured to determine a first baseline compensation coefficient and a first baseline compensation value of the display device based on the abnormal driving parameter of the display device, to determine a second baseline compensation coefficient of the display device based on the first baseline compensation coefficient and coefficient compensation accuracy, the compensation accuracy comprising coefficient compensation accuracy, and to determine the second compensation value of the display device based on the first baseline compensation value and second baseline compensation coefficient.

In the display device of the present application, the display device driver is further configured to determine the first baseline compensation coefficient and the first baseline compensation value of the display device based on the abnormal driving parameter of the display device, to determine a second baseline compensation value of the display device based on a first baseline compensation value and a voltage compensation accuracy of the display device, where the compensation accuracy includes a voltage compensation accuracy, and to determine a second compensation value of the display device based on the second baseline compensation value and first baseline compensation coefficient.

In the display device of the present application, the display device driver is further configured to determine the first baseline compensation coefficient and the first baseline compensation value of the display device based on the abnormal driving parameter of the display device, to determine the second baseline compensation coefficient and the second baseline compensation value of the display device based on the first baseline compensation coefficient, first baseline compensation value, and the compensation accuracy, and to determine a second compensation value of the display device based on the second baseline compensation coefficient and the second baseline compensation value.

An embodiment of the application provides a display device. When the display panel appears to be poorly compensated, the display device driver modifies the compensation value of the display panel by modifying the first compensation value to the second compensation value, where the second compensation value is less than the first compensation value, to prevent the display panel from overcompensation, the purple dots in the display panel, and poor display panel performance.

Figure 9:
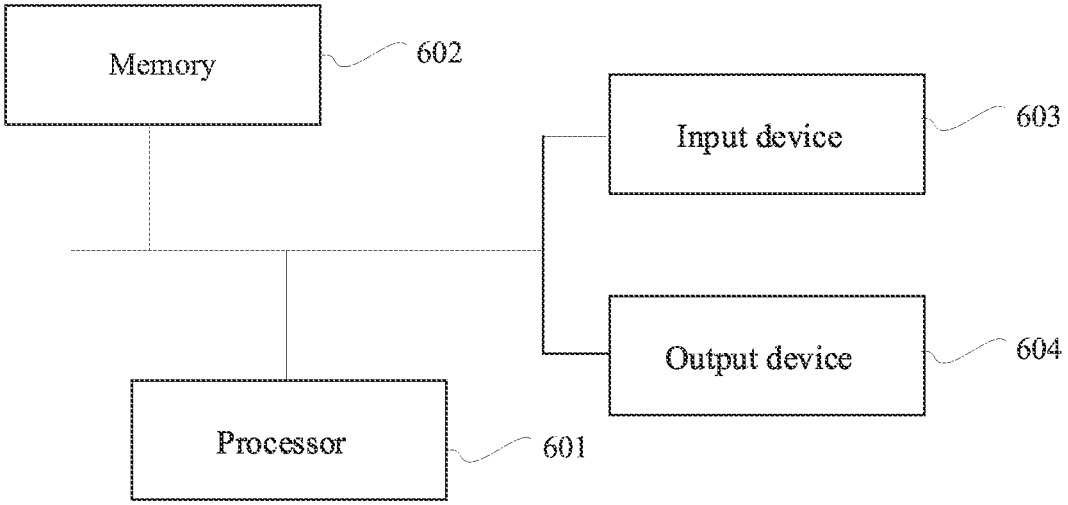
FIG. 9 is a schematic diagram showing a hardware structure of the display device according to an embodiment of the present application.

In addition to the above-described display device and a driving method thereof, an embodiment of the present application provides a display device comprising a memory, a processor, and a computer program stored in the memory and executable on the processor. In particular, the processor executes the program to implement the display device driving method as described in any of the above-described embodiments when the processor executes the program. FIG. 9 is a schematic diagram showing a hardware structure of an embodiment of an apparatus for executing the display device driving method provided by the present application.

As shown in FIG. 9, the device includes one or more processors 601 and a memory 602, with one processor 601 shown as an example in FIG. 9.

The device for executing the display device driving method may further include: an input device 603 and an output device 604. The processor 601, memory 602, input device 603, and output device 604 may be connected via a bus or the similar. FIG. 9 shows the connection via a bus is as an example.

The memory 602, as a non-volatile computer-readable storage medium, can be configured to store non-volatile software programs, non-volatile computer-executable programs, and modules, such as the program instructions/modules corresponding to the display device driving method in the present application embodiment. The processor 601 executes various functional applications of the server and data processing by running the non-volatile software programs, instructions, and modules stored in the memory 602, i.e., embodiments of the display device driving method as aforementioned.

The memory 602 may include a stored program area and a stored data area, wherein the stored program area may store an operating system, application programs required for at least one function. The stored data area may store data created in accordance with the use of the device compensating the mura phenomenon and the like. Additionally, the memory 602 may include high-speed random access memory, and may also include non-volatile memory, such as at least one disk memory device, flash memory device, or another non-volatile solid-state memory device. In some embodiments, the memory 602 may optionally include memory that is remotely located relative to the processor 601, and these remote memories may be connected to a user behavior monitoring device via a network. Examples of the networks include, but are not limited to, the Internet, corporate intranets, local area networks, mobile communication networks, and combinations thereof.

Input device 603 may receive incoming numeric or character information, as well as generate key signal inputs related to user settings of the Mura phenomenon compensation device and control of functions. Output device 604 may include a display device such as a display screen.

The one or more modules are stored in the memory 602 and, when executed by the one or more processors 601, perform the driving method of an arbitrary one of the method embodiments. The device for executing the driving method embodiments has the same or similar technical effects as the aforementioned arbitrary method embodiment.

The above embodiments show that:

The application provides a display device and a driving method thereof. The display device driving method obtains a first driving parameter and a first compensation value of the display device, determines an abnormal driving parameter of the display device based on the first driving parameter and the first compensation value of the display device, then determines a second compensation value of the display device based on the abnormal driving parameter of the display device, and drives the display device using the second compensation value and the first driving parameter. By modifying compensation values for the display panel when the display panel appears to be poorly compensated, the first compensation value is modified to the second compensation value smaller than the first compensation value, and the application prevents the display panel from being overcompensated, eliminates the purple dot in the display panel, and prevents the display panel from poor display performance.

Note that a person with ordinary skills in the art can propose equivalent substitutions or modifications in accordance with the technical solutions and concepts of the invention of the application, and all such modifications or substitutions shall fall within the scope of the claims appended to the application.

What is claimed is:

1. A method for driving a display device, comprising:

obtaining a first driving parameter and a first compensation value of the display device;

determining an abnormal driving parameter of the display device based on the first driving parameter and the first compensation value of the display device;

determining a second compensation value for the display device based on the abnormal driving parameter of the display device, wherein an absolute value of the first compensation value is greater than an absolute value of the second compensation value; and driving the display device using the second compensation value and the first driving parameter;

wherein the step of determining the abnormal driving parameter of the display device based on the first driving parameter and the first compensation value of the display device comprises:

determining a second driving parameter and a minimum compensation value for each pixel according to the first driving parameter and the first compensation value of the display device; and determining the abnormal driving parameter of the display device based on the second driving parameter and the minimum compensation value for each pixel.

2. The method for driving the display device as claimed in claim 1, wherein the step of obtaining the first driving parameter and the first compensation value of the display device comprises:

obtaining a correspondence between a first display mode and a second display mode of the display device;

obtaining a to-be-displayed gray scale and a to-be-displayed luminance of the display device in the first display mode; and determining the first driving parameter and the first compensation value of the display device according to the to-be-displayed gray scale and the to-be-displayed luminance in the first display mode, and the correspondence.

3. The method for driving the display device as claimed in claim 2, wherein the step of determining the abnormal driving parameter of the display device based on the first driving parameter and the first compensation value of the display device comprises:

driving the display device according to the first driving parameter and the first compensation value of the display device to obtain a display screen of the display device;

determining an abnormal display area of the display device based on the display screen of the display device and a standard display screen; and obtaining the first driving parameter and the first compensation value of the abnormal display area of the display device according to the abnormal display area of the display device, to obtain the abnormal driving parameter.

4. The method for driving the display device as claimed in claim 3, wherein the step of determining the second compensation value for the display device based on the abnormal driving parameter of the display device, comprises:

obtaining compensation accuracy of the display device; and determining the second compensation value of the display device based on the abnormal driving parameter and the compensation accuracy of the display device.

5. The method for driving the display device as claimed in claim 4, wherein the compensation accuracy comprises a coefficient compensation accuracy, the step of determining the second compensation value for the display device based on the abnormal driving parameter and the compensation accuracy of the display device comprises:

determining a first baseline compensation coefficient and a first baseline compensation value for the display device based on the abnormal driving parameter of the display device;

determining a second baseline compensation coefficient for the display device based on the first baseline compensation coefficient and the coefficient compensation accuracy; and determining the second compensation value for the display device based on the first baseline compensation value and the second baseline compensation coefficient.

6. The method for driving the display device as claimed in claim 4, wherein the compensation accuracy comprises voltage compensation accuracy, the step of determining the second compensation value for the display device based on the abnormal driving parameter of the display device comprises:

determining a first baseline compensation coefficient and a first baseline compensation value for the display device based on the abnormal driving parameter of the display device;

determining a second baseline compensation value for the display device based on the first baseline compensation value and the voltage compensation accuracy; and determining the second compensation value for the display device based on the second baseline compensation value and the first baseline compensation coefficient.

7. The method for driving the display device as claimed in claim 4, wherein the step of determining the second compensation value for the display device based on the abnormal driving parameter of the display device comprises:

determining a first baseline compensation coefficient and a first baseline compensation value for the display device based on the abnormal driving parameter of the display device;

determining a second baseline compensation coefficient and a second baseline compensation value for the display device based on the first baseline compensation coefficient, the first baseline compensation value, and the compensation accuracy; and determining the second compensation value for the display device based on the second baseline compensation coefficient and the second baseline compensation value.

8. The method for driving the display device as claimed in claim 1, wherein the step of determining the abnormal driving parameter of the display device based on the second driving parameters and the minimum compensation value for each pixel comprises:

determining sub-compensation values of subpixels in each pixel based on the second driving parameter for each pixel;

determining whether a sub-compensation value of one subpixel of the subpixels is less than the minimum compensation value based on the sub-compensation values of the subpixels and the minimum compensation value; and determining the abnormal driving parameter corresponding to the subpixels when the sub-compensation value of the subpixel is less than the minimum compensation value.

9. The method for driving the display device as claimed in claim 1, wherein after the step of determining the second compensation value for the display device based on the abnormal driving parameter of the display device further comprises:

storing the second compensation value.

10. An electronic device comprising a memory and a processor, wherein the memory storing a computer program, the processor configured to execute the computer program in the memory to perform operations in the method for driving a display device of claim 1.

11. A display device comprising a display device driver and a display panel, wherein the display device driver comprising:

an acquisition module configured to obtain a first driving parameter and a first compensation value of the display device;

a first determination module configured to determine an abnormal driving parameter for the display device based on the first driving parameter and the first compensation value of the display device;

a second determination module configured to determine a second compensation value for the display device based on the abnormal driving parameter of the display device, wherein an absolute value of the first compensation value is greater than an absolute value of the second compensation value;

a storage module configured to store the second compensation value; and a driving module configured to drive the display device using the second compensation value and the first driving parameter;

wherein the display device driver is further configured to perform:

determining a second driving parameter and a minimum compensation value for each pixel according to the first driving parameter and the first compensation value of the display device; and determining the abnormal driving parameter of the display device based on the second driving parameter and the minimum compensation value for each pixel.

12. The display device as claimed in claim 11, wherein the display device driver is further configured to perform:

obtaining a correspondence between a first display mode and a second display mode of the display device;

obtaining a to-be-displayed gray scale and a to-be-displayed luminance of the display device in the first display mode; and determining the first driving parameter and the first compensation value of the display device according the to-be-displayed gray scale and the to-be-displayed luminance in the first display mode, and the correspondence.

13. The display device as claimed in claim 12, wherein the display device driver is further configured to perform:

driving the display device according to the first driving parameter and the first compensation value of the display device to obtain a display screen of the display device;

determining an abnormal display area of the display device based on the display screen of the display device and a standard display screen; and obtaining the first driving parameter and the first compensation value of the abnormal display area of the display device according to the abnormal display area of the display device, to obtain the abnormal driving parameter.

14. The display device as claimed in claim 13, wherein the display device driver is further configured to perform:

obtaining compensation accuracy of the display device; and determining the second compensation value of the display device based on the abnormal driving parameter and the compensation accuracy of the display device.

15. The display device as claimed in claim 14, wherein the display device driver is further configured to perform:

determining a first baseline compensation coefficient and a first baseline compensation value for the display device based on the abnormal driving parameter of the display device;

determining a second baseline compensation coefficient for the display device based on the first baseline compensation coefficient and the coefficient compensation accuracy; and determining the second compensation value for the display device based on the first baseline compensation value and the second baseline compensation coefficient.

16. The display device as claimed in claim 14, wherein the display device driver is further configured to perform:

determining a first baseline compensation coefficient and a first baseline compensation value for the display device based on the abnormal driving parameter of the display device;

determining a second baseline compensation value for the display device based on the first baseline compensation value and a voltage compensation accuracy; and determining the second compensation value for the display device based on the second baseline compensation value and the first baseline compensation coefficient.

17. The display device as claimed in claim 14, wherein the display device driver is further configured to perform:

determining a first baseline compensation coefficient and a first baseline compensation value for the display device based on the abnormal driving parameter of the display device;

determining a second baseline compensation coefficient and a second baseline compensation value for the display device based on the first baseline compensation coefficient, the first baseline compensation value, and the compensation accuracy; and determining a second compensation value for the display device based on the second baseline compensation coefficient and the second baseline compensation value.

18. The display device as claimed in claim 11, wherein the display device driver is further configured to perform:

determining sub-compensation values of subpixels in each pixel based on the second driving parameter for each pixel;

determining whether a sub-compensation value of one subpixel of the subpixels is less than the minimum compensation value based on the sub-compensation values of the subpixels and the minimum compensation value; and determining the abnormal driving parameter corresponding to the subpixel when the sub-compensation value of the subpixel is less than the minimum compensation value.

* * * * *